US011047543B1

(12) United States Patent
Potter

(10) Patent No.: US 11,047,543 B1
(45) Date of Patent: Jun. 29, 2021

(54) NARROW APERTURE LIGHT SYSTEM

(71) Applicant: Valeo Vision SAS, Bobigny (FR)

(72) Inventor: Brant Potter, Seymour, IN (US)

(73) Assignee: Valeo Vision SAS, Bobigny (FR)

( * ) Notice: Subject to any disclaimer, the term of this patent is extended or adjusted under 35 U.S.C. 154(b) by 0 days.

(21) Appl. No.: 16/883,342

(22) Filed: May 26, 2020

(51) Int. Cl.

| | |
|---|---|
| ***F21S 41/33*** | (2018.01) |
| ***F21S 41/20*** | (2018.01) |
| ***F21S 41/10*** | (2018.01) |
| ***F21S 41/32*** | (2018.01) |
| ***F21S 41/36*** | (2018.01) |

(52) U.S. Cl.
CPC ..... *F21S 41/335* (2018.01); *F21S 41/10* (2018.01); *F21S 41/285* (2018.01); *F21S 41/321* (2018.01); *F21S 41/337* (2018.01); *F21S 41/36* (2018.01)

(58) Field of Classification Search
CPC ..... F21S 41/147; F21S 41/148; F21S 41/333; F21S 41/334; F21S 41/335; F21S 41/336; F21S 41/337; F21S 41/338; F21S 41/36
See application file for complete search history.

(56) References Cited

U.S. PATENT DOCUMENTS

| | | | | |
|---|---|---|---|---|
| 6,382,822 | B1 | 5/2002 | Maekawa et al. | |
| 7,121,705 | B2 | 10/2006 | Albou et al. | |
| 7,690,826 | B2 | 4/2010 | Kim | |
| 10,060,593 | B2 * | 8/2018 | Zheng | F21S 43/31 |
| 10,655,809 | B1 * | 5/2020 | Juneau | F21S 41/147 |
| 2008/0225540 | A1 * | 9/2008 | Tsukamoto | F21S 41/155 362/514 |
| 2008/0225544 | A1 * | 9/2008 | Fujiwara | F21S 41/29 362/538 |
| 2010/0110714 | A1 * | 5/2010 | Ookubo | F21S 41/155 362/538 |
| 2010/0309676 | A1 * | 12/2010 | Lin | F21S 41/148 362/517 |
| 2011/0149584 | A1 * | 6/2011 | Stade | F21S 41/675 362/512 |
| 2013/0188377 | A1 * | 7/2013 | Konishi | F21S 41/323 362/511 |
| 2014/0056018 | A1 * | 2/2014 | Brendle | F21S 41/147 362/516 |
| 2014/0268850 | A1 * | 9/2014 | Marley | F21S 41/192 362/517 |
| 2014/0307459 | A1 * | 10/2014 | Brendle | F21S 41/151 362/520 |
| 2016/0084465 | A1 * | 3/2016 | Yamamoto | F21S 41/333 362/517 |
| 2017/0153000 | A1 * | 6/2017 | Sato | F21S 41/148 |
| 2018/0252373 | A1 * | 9/2018 | Jo | F21S 4/28 |

FOREIGN PATENT DOCUMENTS

WO 2015/191387 A1 12/2015

* cited by examiner

*Primary Examiner* — Alexander K Garlen
(74) *Attorney, Agent, or Firm* — Young Basile Hanlon & MacFarlane, P.C.

(57) ABSTRACT

A light system comprising: (a) one or more reflectors; (b) a lens; (c) an optical axis extending through the one or more reflectors, the lens, or both; and (d) a light source located entirely on one side of the optical axis so that light from the light source is directed at an angle relative to the one or more reflectors and the one or more reflectors redirect the light through the lens.

18 Claims, 7 Drawing Sheets

NARROW APERTURE LIGHT SYSTEM

FIELD

The present teachings relate to a light system including lights are directed through lenses so that a field illuminated remains the same while an aperture out of a vehicle is reduced.

BACKGROUND

Headlights in vehicles typically are static in position and once aimed maintain the aim. In order to illuminate a larger area the headlights are switched from a low beam to a high beam. In order to illuminate a predetermined field size the light extends out of the vehicle at a predetermined angle through a predetermined aperture size. Typically, the larger the aperture size the larger the area illuminated by the headlights.

Examples of light systems may be disclosed in U.S. Pat. Nos. 6,382,822; 7,121,705; and 7,690,826 and PCT Publication No. WO2015/191387 all of which are expressly incorporated herein by reference for all purposes. Thus, there is a need for a light system where the light source is located horizontally off a center axis, vertically off of a center axis, or both. There is a need for a system with a reduced aperture size due to an orientation of a lens, an outer lens, or both within the light system. It would be desirable to have a light system where the lights extend through two or more lenses.

SUMMARY

The present teachings provide: a light system comprising: (a) one or more reflectors; (b) a lens; (c) an optical axis extending through the one or more reflectors, the lens, or both; and (d) a light source located entirely on one side of the optical axis so that light from the light source is directed at an angle relative to the one or more reflectors and the one or more reflectors redirect the light through the lens.

The present teachings provide a light system where the light source is located horizontally off a center axis, vertically off of a center axis, or both. The present teachings provide a system with a reduced aperture size due to an orientation of a lens, an outer lens, or both within the light system. The present teachings provide a light system where the lights extend through two or more lens.

DETAILED DESCRIPTION

Figure 1:
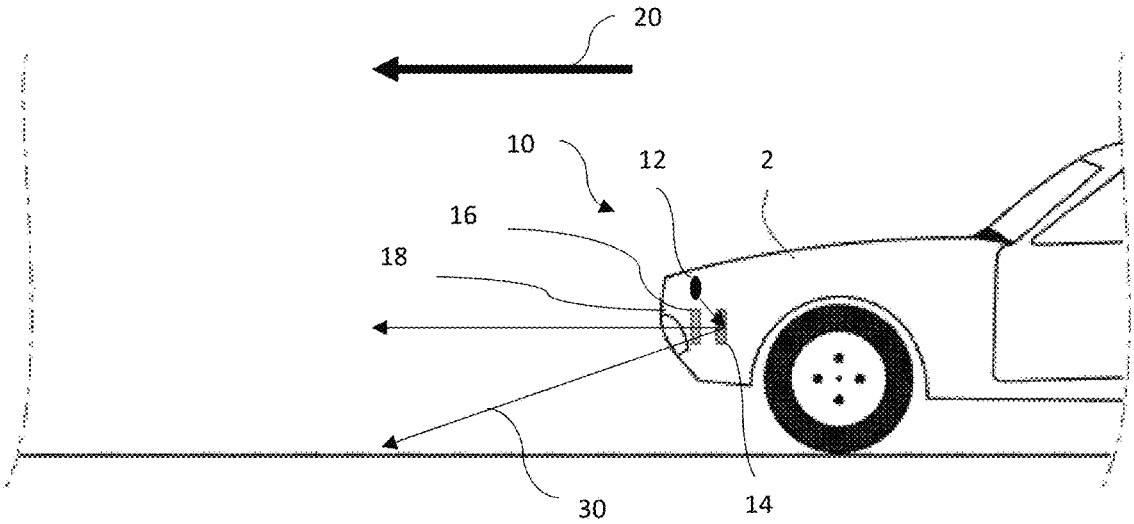
FIG. 1 is a side view of a vehicle including the light system.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings relate to a light system. The light system is located with a vehicle. Preferably, the light system is part of a vehicle such as a car, motorcycle, bus, truck, semi-truck, SUV, XUV, four-wheeler, dirt bike, tractor, combine, heavy equipment, farm equipment, industrial equipment, commercial equipment, or a combination thereof. The light system may project in a forward direction, rear direction, side direction, or a combination thereof. Preferably, the light system projects a light from an external surface of the vehicle to a location in front of the vehicle. The light system may direct some light at the ground. The light system may direct some light above the ground. The light system may be integrated into a front end, a rear end, or both of a car. The light system may project light out of the vehicle. The light systems may be multiple light systems stacked one above the other. The light of the vehicle may be two or more, three or more, or four or more light systems located one above another. A height of each of the light systems may be decreased by the light source being moved to a side of the reflector (e.g., versus above or below the reflector). The light system may include one or more light assemblies and preferably a plurality of light assemblies.

The light sources function to produce light. The light source may be a device or a plurality of devices that create light and the light extends outward from the light source. The light source may produce a high beam, a low beam, a blending beam, or a combination thereof. The light source may be aimed for near light, far light, blending light that blends the far light and near light together, or a combination thereof. The light source may comprise a plurality of lights. For example, the light source may have a first light that is directed to the first reflector facet, a second light that is directed to the second reflector facet, a third light that is directed to the third reflector facet, and fourth light that is directed to the fourth reflector facet. The plurality of lights may be in one group and may direct light to the reflector facets. The light source may be a single light that projects light. In another example, a single light source may direct light to the first reflector facet, the second reflector facet, the third reflector facet, and the fourth reflector facet. The light source may be directional light. The light source may have an emission that is a Lambertian emission or a narrow emission angle. The directional light source may concentrate light on the reflector. The light source may include a laser diode, glowing phosphor, filament bulb, or a combination thereof. The light source may create light may extend at an angle of about 15 degrees or more, about 30 degrees or more, about 45 degrees or more, or about 60 degrees or more from an optical axis of the light source into contact with the one or more reflectors (e.g., when viewing a two dimensional representation of the light from the light source, the light includes a first edge at a first angle and a second edge at the first angle from the optical axis). The light source may create light that may extend at an angle of about 150 degrees or less, about 135 degrees or less, about 115 degrees or less, about 105 degrees or less, or about 90 degrees or less from an optical axis of the light source into contact with the one or more reflectors (i.e., about 60 degrees on each side of the optical axis). For example, the light source may produce light having a cone that extends at 60 degrees on each side of the optical axis and the edges of the light may form an angle of about 45 degrees on one side and about 90 degrees on a second side with the one or more reflectors. The angle of the light from the light source may form different angles with the reflector due to a shape of the reflector (e.g., parabolic shaped).

The light source may be any type of lighting device that produces light such as an incandescent bulb, fluorescent light, compact fluorescent lamp, halogen lamp, light emitting diode (LED), high intensity discharge lamps (HID); halogen lights, xenon lights, a laser diode, phosphorous bulb, or a combination thereof. The light source may be a single lamp or bulb. Preferably, the light source includes a plurality of lamps, bulbs, diodes, or a combination thereof. The light source may be an array. The light source may include two or more, 5 or more, 10 or more, 20 or more, or even 50 or more devices that produce light and combine together to form the light source. The light source may include 500 or less, 300 or less, or 200 or less devices that produce light. For example, if the light source is a 10×10 array of light devices some of the 100 devices may be selectively turned on and off, dimmed, brightened, or a combination thereof. Preferably, the light sources may be a single light source that is aimed at a focus of a single reflector. The light source may be static. The light source may be free of movement. The light source may be fixed. The light sources may be static and may be manually or physically adjusted so that the light sources are directed to a desired location. The light source may be fixed and the light from the light source may be moved, bent, directed, or a combination thereof by optical elements or reflectors. Each device of the light source may be turned on an off. The light source may be located within a light system at a location relative to a reflector. The light source may be located entirely on one side of an optical axis extending through the lens. The light source may be located entirely outside an outer edge of a reflector. The light source may be located farther from an optical axis, a longitudinal axis, or both than a first outer edge of a reflector. The light source may be located outside of all of the indirect light reflecting off of the reflector. The light source may be located farther from an optical axis extending through the reflector than both outside edges of the reflector (e.g., first outside edge and second outside edge). The light source may be coplanar with a region of the one or more reflectors, the lens, or both. The light source may be coplanar with a center of the one or more reflectors, the lens, or both. The light source may be located on a horizontal axis that bisects the one or more reflectors, the lens, or both. The light source may direct light above a driving surface (e.g., some light may contact and illuminate the driving surface by a center of the light may be located above the driving surface). The light source may be directed substantially parallel to the light surface (e.g., ground). For example, a center of the light, an axis of the light, or both may extend parallel to the driving surface. The light source may be directed directly out of the vehicle. The light source may be directed along a vertical axis and some light may extend outward along a horizontal axis. The light source may extend along an optical axis or may be directed away from the optical axis.

The optical axis is an axis of light extending away from a vehicle, a light system, or both. The optical axis may be a center of light extending away from a vehicle. The optical axis may be a center of a cone of light. The optical axis may extend through a center of a lens, a center of a curvature of a lens, a center of a reflector, or both. The optical axis may bisect the lens (e.g., primary lens), the reflector, or both. The optical axis may extend towards the reflector, through the lens, or both. Preferably, the optical axis contacts the reflector in a first direction and then extends through a lens in a second direction. The optical axis may extend substantially parallel to a vertical axis or a longitudinal axis. The longitudinal axis may bisect a length of a vehicle. The vehicle may have an optical axis on a first side (e.g., a left-handed light) of the longitudinal axis and a second optical axis on a second side (e.g., a right-handed light) of the longitudinal axis. The vertical axis, longitudinal axis, and the vertical axis all extend parallel or substantially parallel to one another. A horizontal axis may extend substantially parallel to the optical axis, vertical axis, longitudinal axis, or a combination thereof. The horizontal axis may extend along a width of a vehicle. The horizontal axis may be located on a first side and a second side of the longitudinal axis, vertical axis, optical axis, or a combination thereof.

Each of the light systems, light sources, or both may direct light on a first side and a second side of an optical axis. Some of the light may extend on an inboard side of the optical axis (e.g., in a direction towards a center of a vehicle). Some of the light may extend on an outboard side of the optical axis (e.g., in a direction away from a center of a vehicle). The light may extend farther on an outboard side than an inboard side of a light. The light on the inboard side may illuminate a region between two light sources and in front of a vehicle. A right-handed light and a left-handed light may each include light that extends inboard (e.g., on an inboard side) so that the inboard lights overlap and illuminate in front of a vehicle. A right-handed light and a left-handed light may each include light that extends outboard (e.g., on an outboard side) of a vehicle so that the outboard light illuminates a region outside of the vehicle, sides of a road, or both. The light from each of the light sources may extend outward from the light source at an angle towards an inboard side and an outboard side. The light extending on the inboard side may extend outward from the light source, vehicle, or both at an angle of about 10 degrees or more, about 20 degrees or more, about 25 degrees or more, or about 30 degrees or more relative to the optical axis. The light extending on the inboard side may extend outward from the light source, the vehicle, or about at an angle of about 50 degrees or less, about 40 degrees or less, or about 35 degrees or less relative to the optical axis. The light extending on the outboard side may extend outward from the light source, vehicle, or both at an angle of about 20 degrees or more, about 30 degrees or more, about 35 degrees or more, or about 40 degrees or more relative to the optical axis. The light extending on the outboard side may extend outward from the light source, the vehicle, or about at an angle of about 60 degrees or less, about 50 degrees or less, or about 45 degrees or less relative to an optical axis. An angle the light extends on an inboard side and an outboard side of the optical axis may be varied based on a shape of a reflector.

The reflector functions to direct light to a predetermined location, in a predetermined direction, or both. The reflectors may direct light from the light sources so that near light, far light, blended light, or a combination thereof are directed outward from the light system. The reflector may redirect light at an angle of about 20 degrees or more, about 25 degrees or more, about 30 degrees or more, about 35 degrees or more, about 40 degrees or more, or about 45 degrees or more. The reflector may redirect light at an angle of about 135 degrees or less, about 115 degrees or less, about 105 degrees or less, about 90 degrees or less, or about 75 degrees or less. The reflector functions to extend light through a first lens (e.g., a primary lens within a light system), a second lens (e.g., an outer lens), or both. The lens (i.e., primary lens) may be located between an outermost lens and the one or more reflectors. The reflector and lens may be located a distance from one another. The reflector may be located a first distance from the lens on a first side and a second distance from the lens on a second side. The first distance may be greater than the second distance. A first outside edge of the reflector may be located a greatest distance from the lens and a second outside edge of the reflector may be located closest to the lens. Each of the facets of the reflector may be located a distance from the lens. Starting at a first outside edge and extending towards the second outside edge, each facet may be located closer to the lens. The distance between the reflector and the lens may vary based upon a curve of the reflector, shape of the lens, or both. The distance between the lens and the reflector at a first outside edge, a second outside edge, or both may be about 1 mm or more, about 3 mm or more, about 5 mm or more, about 7 mm or more, about 1 cm or more, about 1.5 cm or more, about 2 cm or more, or about 5 cm or more. The distance between the lens and the reflector at a first outside edge, a second outside edge, or both may be about 10 cm or less, about 7 cm or less, about 5 cm or less, or about 3 cm or less. The reflector may have a ratio of distances between the first outside edge and the second outside edge. The ratio of the distance at the first outside edge to the second outside edge may be about 1.2:1 or more, about 1.5:1 or more, about 2:1 or more, about 2.5:1 or more, about 3:1 or more, about 3.5:1 or more, or about 4:1 or more. The ratio of the distance at the first outside edge to the second outside edge may be about 10:1 or less, about 7:1 or less, or about 5:1 or less. The distance between the reflector and the lens may determine the spread of light, the contact angle between the lens and the indirect light, or both.

The reflector functions to aim light, redirect light, spread light, or a combination thereof. The reflector may intensify light from the light sources. Light that contacts the reflector may be spread and redirected (e.g., light may not be only a beam of light the light may be spread). The reflector may form a predetermined light pattern. The reflector, the light source, PCB, or a combination thereof may all be aligned relative to each other so that a light pattern is created. The reflector may include an outer edge. The outer edge of the reflector and the light source may be located proximate to one another. Preferably, the light source may be located farther from an optical axis than an outer edge of the reflector. The light source may be located outside of the reflector so that a line extending from an outer edge of the reflector to the lens does not pass through the light source. The light pattern may be determined based upon the shape of the reflector. The reflector may have a shape that is generally parabolic. For example, the reflector may have a curvature that is substantially symmetric in a vertical direction, a horizontal direction, or both. The reflector may be asymmetric (e.g., one side may be longer than another side or more curve more than an opposing side. The reflector may be "C" shaped, "U" shaped, "J" shaped, "L" shaped, be convex, be concave, or a combination thereof. The reflector may receive light directly from the light source and then reflect the light in another direction. The reflector may have a shape disclosed herein when all of the facets, sub-facets, or both are viewed together. The reflector may have one or more facts, one or more sub-facets, or both. Preferably, the reflector has a plurality facets and each of the plurality of facets include sub-facets and each of the sub-facets direct light through the lens, generally along an optical axis, and to a region outside of a vehicle. The reflector may have a surface area that is greater than a surface area of the lens. The surface area of the reflector may be about 1.1 times or more, about 1.2 times or more, about 1.3 times or more, about 1.5 times or more, or even about 1.7 times or more than that of the lens. The surface area of the reflector may be about 3 times or less, about 2.5 times or less, or about 2 times or less than that of the lens. Multiple reflectors may be combined together to create a predetermined light pattern. The reflector and the lens each include a height and a length. The height of the reflector may be greater than a height of the lens. The height of the reflector may be about 1.1 times or more, about 1.2 times or more, or about 1.3 times or more that of a height of the lens. The height of the reflector may be about 3 times or less, about 2 times or less, or about 1.5 times or less that of a height of the lens. The reflector may have one or more facets. The reflector may have a plurality of facets. Each of the plurality of facets may direct or reflect light to a different location. The facets may create an array of light. The array of light may cover an area with a spectrum or range of light. The reflector may have a first reflector facet, a second reflector facet, a third reflector facet, etc. . . . . The reflector may have a plurality of reflector facets.

The reflector facets may function to redirect light to a predetermined location. Some or all of the reflector facets function to create a shape or indication of direction of the reflected light. One or more of the reflector facets may curve in a vertical direction. The one or more reflector facets may curve so that a vertical surface of the reflector has a generally curved shape. The one or more reflector facets may curve in a horizontal direction. Each of the reflector facets may be individually curved in the horizontal direction or when combined together may create one continuous curve. The plurality of facets in the horizontal direction may be stepped (e.g., a first surface may extend above a second surface of an adjacent facet or vice versa). The reflector may create steps in the single reflector by the plurality of facets. The one or more reflectors may be a plurality of reflectors that are located one another. The one or more reflectors may be a plurality of reflectors located one another. The one or more reflectors may be a plurality of reflectors forming facets that are located adjacent one another. The reflector facets, sub-facets, or both may direct light onto the ground, above the ground, or both. The reflector facets, sub-facets, or both may reflect light from a light source outward from a vehicle. The reflector facets, sub-facets, or both may direct light to a predetermined location. Each reflector may be a single reflector. The one or more reflectors may be a single reflector. The reflector may be a dingle reflector with a plurality of reflector facets, plurality of sub-facets, or both.

The reflector may direct substantially all of the light through a single lens (e.g., except for light that is blocked by a shield). Each light assembly may include one reflector or a plurality of reflectors. The reflector facets may be a first reflector facet, a second reflector facet, a primary reflector facet, a blended reflector facet, or a combination thereof. The first reflector facet and the second reflector facet may direct light generally to a same location. The first reflector facet may direct light in a first direction. The second reflector facet may direct light in a second direction. The first reflector facet and the second reflector facets may create one or more light patterns. The first direction and the second direction may cross so that the one or more light patterns may be formed or a single light pattern may be formed by the first reflector facet and the second reflector facet. The first reflector facet and the second reflector facet may be located within a same plane. Preferably, the first reflector facet and the second reflector facet extend out of a primary plane as the primary reflector facet, out of a blended plane as the blended reflector facet, or both. The first reflector facet and the second reflector facet may be aimed generally towards each other. The reflector may include two or more, four or more, six or more, or eight or more facets. The reflector may include 20 or less, 15 or less, or 10 or less facets. The each of the reflector facets or totality of the reflector facet may have a generally parabolic shape, may form a concave region therebetween, may have curvature, or a combination thereof. The shape of the facet may determine a type of light reflected.

The facets may reflect light so that the light is blended light, foreground light, spread light, intermediate light, cutoff light, a hotspot, or a combination thereof. The foreground light may illuminate a large region in a direction of motion. The foreground light may be a primary light source that an operator views while a vehicle is moving. The foreground light and spread light may have a substantial overlap (e.g., 50 percent or more, 60 percent or more, 75 percent, or more, or 90 percent or less). The spread light may have a length that is greater than a length of the foreground light so that a region outside of a width of the vehicle may be illuminated. The intermediate light may be a blend light that blends the foreground light and spread light. The intermediate light may illuminate a region wider than the spread light (e.g., wider than the vehicle and the spread light). The intermediate light may illuminate a region generally in a direction of movement of the vehicle. The intermediate light may be at least partially overlapped by a cutoff light. The cutoff light may create a hot spot. The cutoff light may illuminate a distal region in front of a vehicle. The cutoff may illuminate a region proximate to the vehicle. The reflector facets may be angled inwards towards a center line or optical axis that extends along the reflector. The reflector facets may each include sub-facets. The sub-facets and facets may work in conjunction to reflect the light to create light that is blended light, foreground light, spread light, intermediate light, cutoff light, a hotspot, or a combination thereof. The foreground light may illuminate a large region in a direction of motion.

The sub-facets may function to change a shape of a reflector or a facet. Each reflector facet may include sub-facets. The sub-facets may each be a change in shape along a facet. The sub-facets may each be flat, curved, concave, convex, symmetrical, asymmetrical, or a combination thereof. Each facet may include two or more or three or more sub-facets. Each facet may include 10 or less, 8 or less, 6 or less, or about 4 or less sub-facets. The sub-facets may be angled relative to each other. The sub-facets may extend at an angle of about 5 degrees or more, about 10 degrees or more, about 15 degrees or more, about 20 degrees or more, or about 25 degrees or more relative to each other. The sub-facets may extend at an angle of about 45 degrees or less, or about 40 degrees or less, about 35 degrees or less, or about 30 degrees or less relative to each other. The sub-facets may have a curved shape. The curved shape may be arcuate. Each of the sub-facets may have a line that is tangential to point on the sub-facet. Thus, for example, a tangent line along an upper sub-facet may have an angle relative to a tangent line along a middle sub-facet. The sub-facets may have an angle relative to vertical (e.g., direction of gravity). For example, a facet may include three sub-facets, a center of the three sub-facets may extend substantially parallel to the lens and then a sub-facet located above and below the center sub-facet extend at an angle of about 10 degrees relative the center sub-facet. The sub-facets may be an upper sub-facet, middle sub-facets, lower sub-facets, or a combination thereof. The upper sub-facets may be located above the middle sub-facets and the lower sub-facets. The upper-sub facets may be angled downward relative to an optical axis the middle sub-facet, the lower sub-facet, vertical, or a combination thereof. The sub-facets may angle a cone of light (e.g., reflected light) away from each of the sub-facets. The parabolic shape of the reflector may have one side that is closer to a lens and one side that is farther from a lens.

The one or more lenses function to direct the light from the reflectors to a location to be illuminated. The lenses may bend light. The lenses may refract light. The lenses may diffuse the light, blend the light, spread the light, direct the light to a predetermined location, create one or more hot spots, or a combination thereof. The lens may be located in front of the reflectors, the light sources, or both. The one or more lenses may be located inside of an external lens. The lenses may cover all or a portion of the light system, the light source, the reflectors, or a combination thereof. Each light system may include a lens. Thus, if there are three light systems or light sources then each light system or light source may include a lens. For example, the light system may include three lights and each of the three lights may include a lens. In another example, a light system may include a kink light, spread light, and high beam light and each may include a lens. The lens may cover the reflectors so that light, direct light, reflected light, or a combination thereof extends through the lens. The lens may be one or more lenses. The lens may be a plurality of lenses. The lens (e.g., primary lens or internal lens) may be a single lens. The one or more lenses may have a shape that directs light to a predetermined location. The one or more lenses may be flat, planar, bio-convex, plano-convex, positive meniscus, negative meniscus, plano-concave, bio-concave, double convex, converging, diverging, or a combination thereof. Each lens may be a single lens. Each lens may be a compound lens (e.g., there may be more than one lens). Each lens has a forward side and a rearward side.

The forward side, the rearward side, or both function to reflect the light, refract the light, spread the light, aim the light to a predetermined location, or a combination thereof. The forward side and the rearward side may be parallel to each other. The forward side and the rearward side may have an angle relative to one another. For example, a forward surface may be planar and the rearward surface may be curved or angled. Conversely, the rearward surface may be planar and the forward surface may be curved. The shape of the forward surface, the rearward surface, or both may have a shape. The shape of the forward surface, the rearward surface, or both may be selected to determine where light is directed. The forward surface, the rearward surface, of both may cause light to diverge, converge, spread, create a hot spot, blend the light, or a combination thereof. The forward side, the rearward side, or both may be concave, convex, spherical, or a combination thereof to produce a shape such as bioconcave, bioconvex, plano-concave, plano-convex, meniscus, or a combination thereof. The forward side may be located proximate to a lens (e.g., an outer lens) of the light system.

The outer lens may function to protect the light system, house all of the internal components, or both. The lens (e.g., outer lens) may be an outer most part of a light system. The lens may receive all of the light from the lens to be directed outward from the vehicle, in a direction of movement of a vehicle or, both. The lens may be sufficiently strong to protect the light system from rocks and debris as the vehicle moves. The lens may cover all of the light sources of the light system (e.g., a kink light, spread light, high beam light). The lens may be transparent so that light may extend through the outer lens. The outer lens may cover all of the lights (e.g., kink light, spread light, high beam light).

The light functions to illuminate a region of direction of a vehicle. The light may illuminate a forward region, a side region, or both of a vehicle. The kink light may asymmetrically aim the light. The link light may include a bend. The kink light may bend the light upward, downward, bend the light, create a cutoff portion of the light, or a combination thereof. The link and spread light may blend together. The spread light may extend light outward from the optical axis, outward from the optical axis relative to the kink light, or both. The spread light may act to blend the lights together so that there are not dark spots or hot spots. The spread light, kink light, or both may operate while a high beam light is in operation. The high beam light may increase an intensity of light so that a larger region is illuminated, a farther distance in a direction of movement is illuminated, or both. The high beam light, kink light, spread light, or a combination thereof may all include direct light and indirect light.

The direct light functions to extend light from a light source to a reflector. The direct light may be directed away from a region to be illuminated. Direct light may extend in a first direction and reflected light may extend in a second opposite direction. The direct light may be aimed at a reflector. The direct light may be a first direct light, a second direct light, a primary direct light, a blended direct light, or a combination thereof. The direct light may be characterized based upon a location the direct light contacts the reflector. The direct light may contact one or more of the reflector facets. Preferably, the direct light contacts all of the facets of a reflector. More preferably, the direct light illuminates entirely all of the reflector. The direct light is directed from a light source to a reflector. The direct light may have a first edge and a second edge that are both located within a first edge and second edge of the reflector (e.g., within outside edges of the reflector). The directly light may span a region. Preferably, all of the direct light contacts the reflector. All of the direct light may span a region and the region may contact reflector. Direct light may be contact a shield so that any light not directed to the reflector may be blocked. The direct light may contact the reflector and then be reflected light that extends from the reflector towards a predetermined location or an aimed location.

The reflected light functions to form a light pattern, illuminate a region around a vehicle, illuminate in a direction of movement, extend through one or more lenses, or a combination thereof. The reflected light may illuminate a surface, an object, a location of interest, or a combination thereof. The reflected light may be a first reflected light and a second reflected light. The reflected light may span a region in a direction of movement of a vehicle. The reflected light may be the light that illuminates so that objects, vehicles, animals, people, or a combination there may be avoided. The reflected light may extend along an optical axis. The reflected light may be form the configuration discussed herein regarding extending on an inboard side and outboard side of the optical axis. Thus, for example, the reflected may extend in an outboard direction at an angle of about 43 degrees from the optical axis and in the inboard direction at an angle of about 30 degrees relative to the optical axis. The shape of the reflected light may be controlled or changed via one or more shields.

The one or more shields function to prevent stray light from being transmitted. The shield may block some light from the light source to the reflector or a region around the reflector, to the lens by bypassing the reflector, or both. The one or more shields may be made of an opaque material, a material that absorbs light, a material that blocks light, a material that is free of reflecting light, or a combination thereof. The one or more shields may be planar, straight, curved, bend, have an "L" shape, have an "M" shape, extend along a first side of a light source, extend along both a first side and a second side of a light source, or a combination thereof. The one or more shields may assist in controlling a shape of the light, an isocandela shape of the light, or both.

FIG. 1 illustrates a top view of a vehicle 2 including a light system 10. The light system 10 includes light sources, reflectors 14, and lenses 16, 18. The vehicle 2 and light 30 are projected in the direction 20 in front of the vehicle 2. The light 30 is created by the light source 12 and directed to the reflector 14. From the reflector 14 the light 30 extends through a first lens 16 and an outer lens 18 to illuminate a region outside of the vehicle 2.

Figure 2:
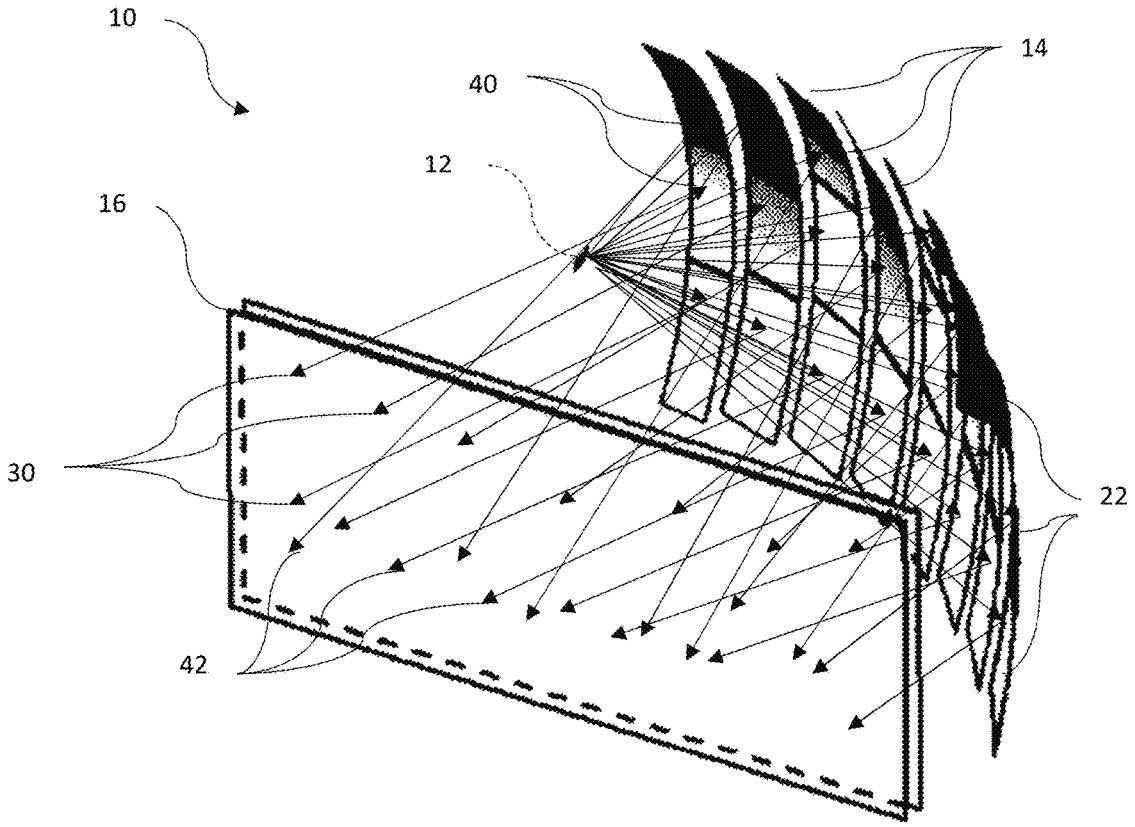
FIG. 2 is perspective view of a light system.

FIG. 2 illustrates a light system 10 with a light source 12 located along a side of the reflector 14 and lens 16. The reflector 14 has a plurality of facets 22 so that the reflector is curved in both the vertical direction and the horizontal direction. The facets 22 redirect the light 30 (direct light 40) from the light source 12 through the lens 16 (indirect light 42). As shown, the facets 22 in vertical direction are labeled.

Figure 3:
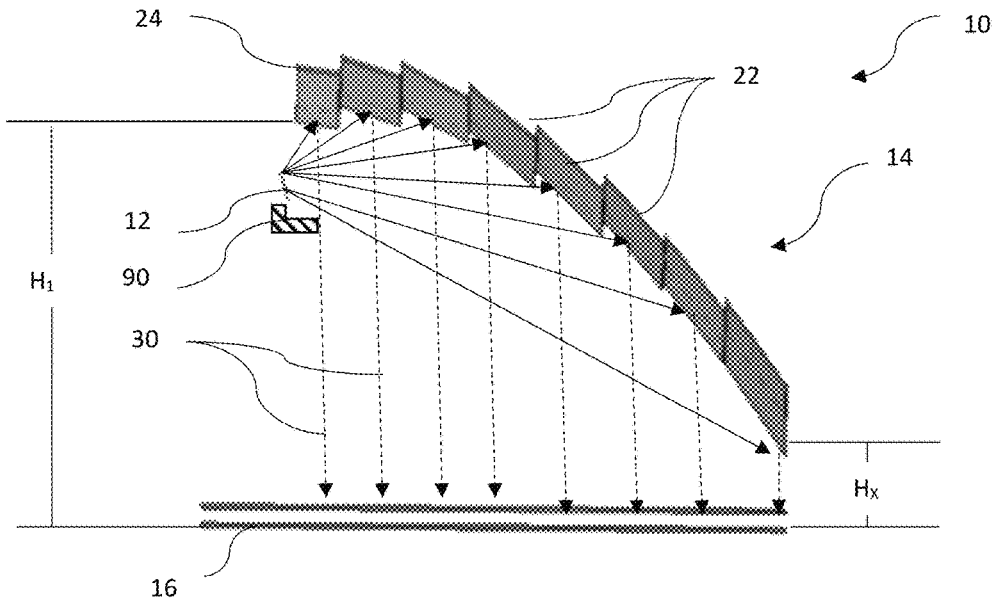
FIG. 3 is a top view of a light system.

FIG. 3 is a top view of a light system 10. The light system 10 includes a light source 12, a reflector 14 with a plurality of horizontal facets 22, and a lens 16. The light source 12 creates light 30, which is projected to the facets 22 of the reflector 14. A shield 90 is located proximate to the light source 12 and prevents light from extending from the light source 12, reflectors 14, or both in a direction outside of the lens 16. The facets 22 are located a distance ($H_1$ through $H_X$) from the lens 16 and the facets 22 redirect the light 30 through the lens 16. The reflector 16 includes an outside edge 24 and the light source 12 is located outside of the outside edge 24.

Figure 4:
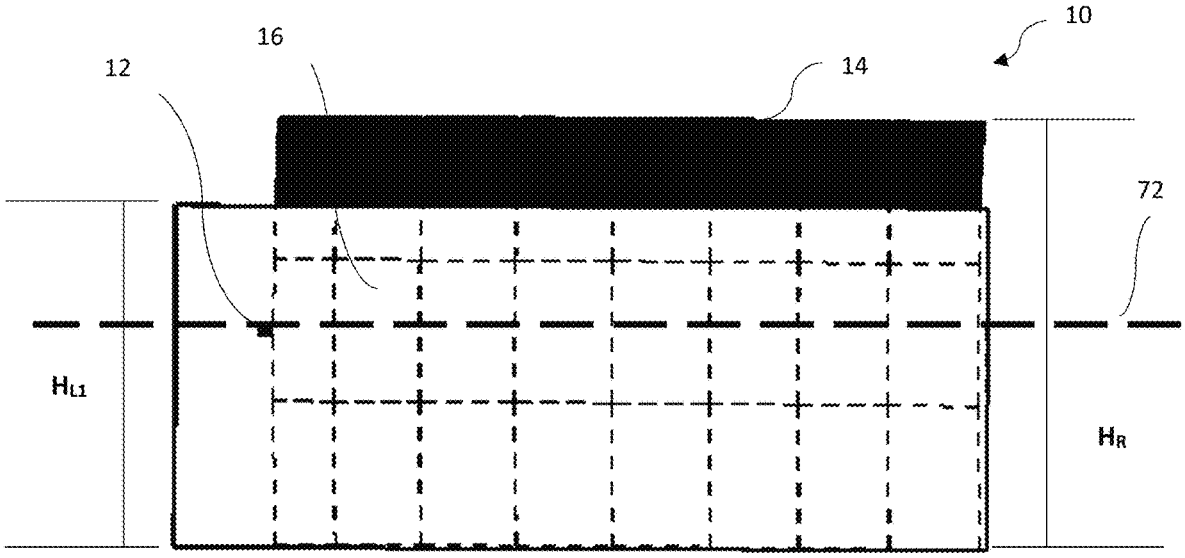
FIG. 4 is front view of a light system.

FIG. 4 is a front view of the light system 10. The light system 10 includes a reflector 14 having a height ($H_R$) and a lens 16 having a height ($H_{L1}$). The height of the lens 16 is less than the height of the reflector 14. The light created by the light source 12 is reflected off of the reflector 14 and through the lens 16 so that a predetermined area is illuminated. The shape of the reflector 14 is such that the light is directed through a lens 16 with a smaller area than the reflector 14. The light source 12 is located on horizontal axis 72.

Figure 5:
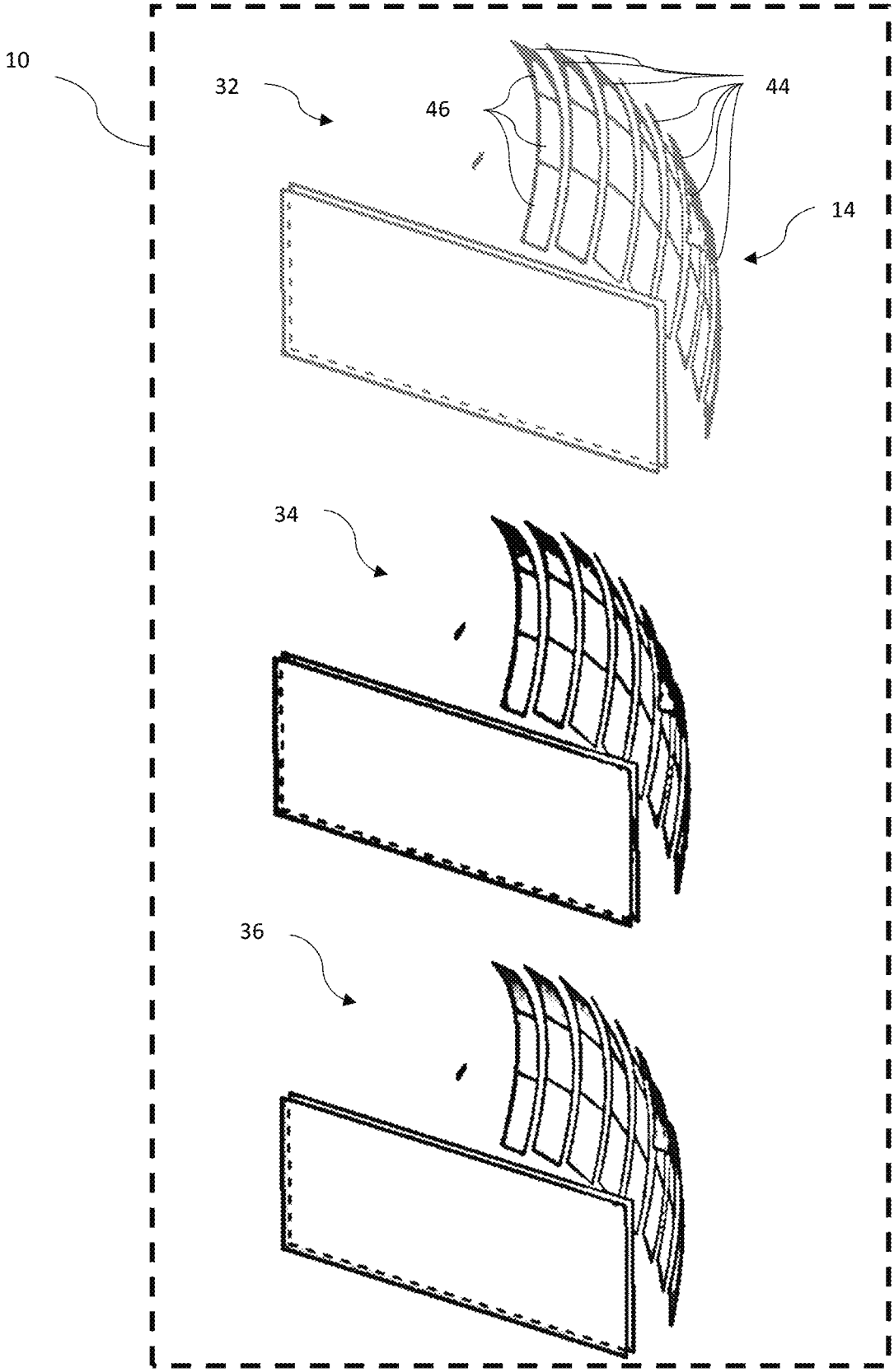
FIG. 5 is a perspective view of a light system including a plurality of lights sources and reflectors.

FIG. 5 illustrates a light system 10 including three different lights that illuminate a region around a vehicle (not shown). The light system 10 includes a kink 32, a spread 34, and a high beam 36 each of which provide different light at different intensities around a vehicle. Each of the kink 32, spread 34, and high beam 36 include reflectors 14 having a plurality of reflector facets 44 and sub-facets 46 along each of the reflector facets 44 that redirect the light in a predetermined direction.

Figure 6:
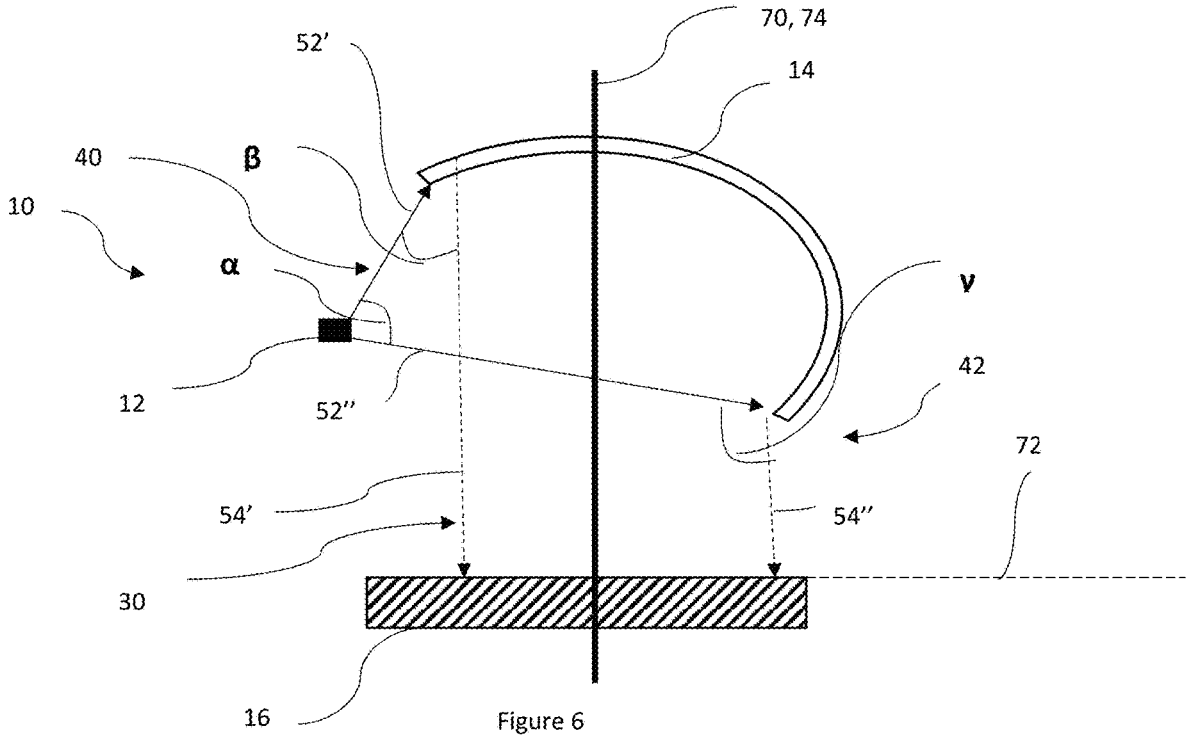
FIG. 6 is a top view of a light system.

FIG. 6 is a top view of the light system 10 depicting the angles or reflection of the light 30 and the angle of the reflector 14 relative to the lens 16. The light source 12 creates light 30, which is directed towards the reflector 14 along an optical axis 74, which is also a vertical axis 70. The light source 12 is located entirely on one side of a vertical axis 70 and as shown is located to the side of the reflector 14 and the lens 16. The light 30 has a directed light with a first side 52' and a second side 52" that are separated by an angle (a). The directed light 52' and 52" contacts the reflector 16 and then is redirected through the lens 16. The directed light on the first side 52' is redirected by the reflector 16 and becomes redirected light 54' that extends at an angle (13) relative to the directed light 52'. The first side 52' and second side 52" illustrate sides of the direct light 40, and the first side 54' and the second side 54" illustrate sides of the indirect light 42 extending through the lens 16 The directed light on the second side 52" is redirected by the reflector 16 and becomes redirected light 54" that extends at an angle (y) relative to the directed light 52".

Figure 7:
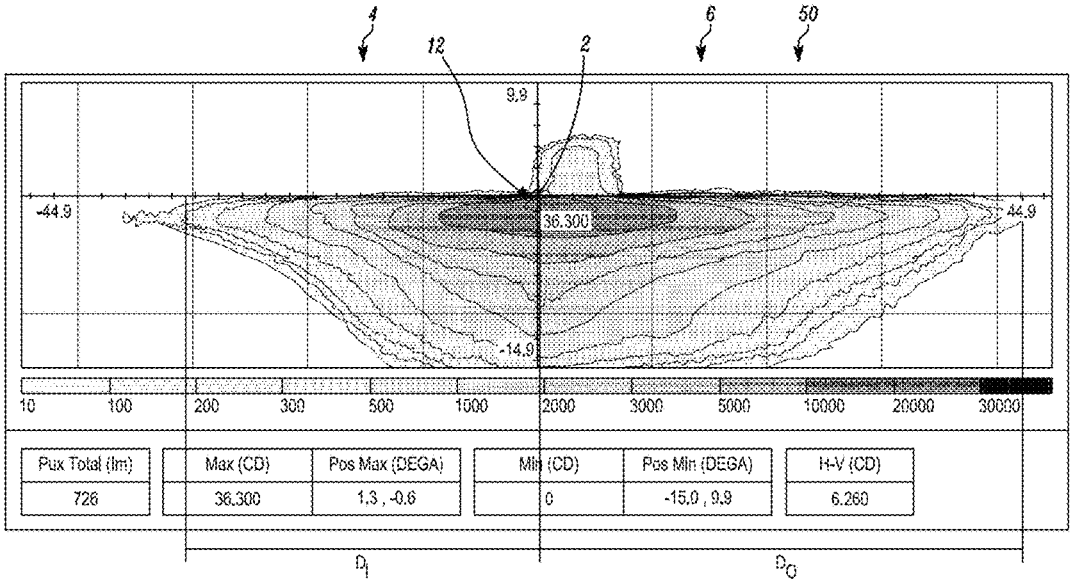
FIG. 7 is an isocandela showing a light pattern of a light system.

FIG. 7 is an isocandela 50 showing the light source 12 of a vehicle from the right side light of the vehicle 2 (i.e., a right-handed light). The light from the light source 12 extends towards an inboard side 4 a distance ($D_I$) and towards an outboard side 6 a distance ($D_O$) from a longitudinal axis 76 of the vehicle 2. A left-handed light creates an isocandela that is a reverse mirror image of the isocandela shown.

Figure 8:
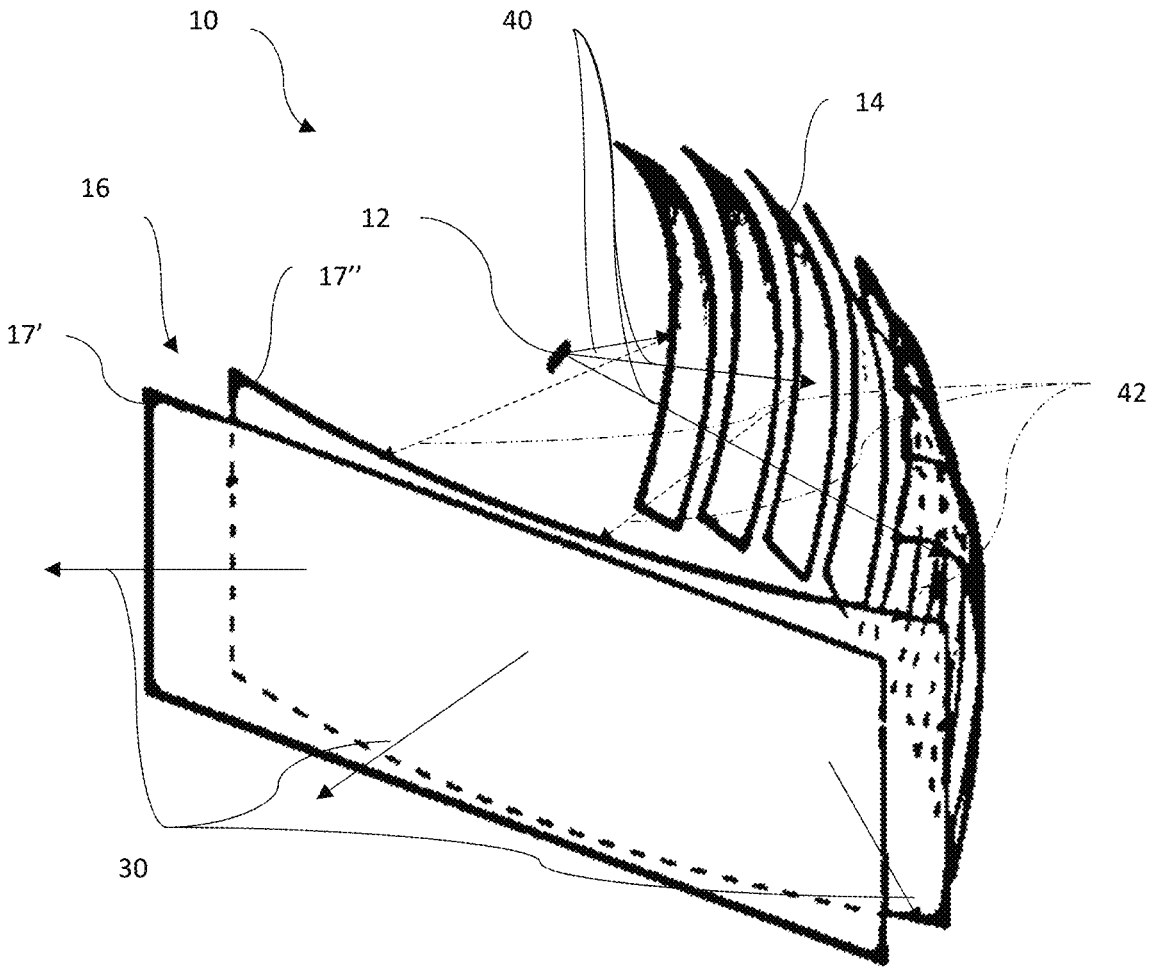
FIG. 8 is a perspective view of a light system including a lens having curvature.

FIG. 8 illustrates a light system 10 with a light source 12 located along a side of the reflector 14 and lens 16. The reflector 14 has a plurality of facets so that the reflector is curved in both the vertical direction and the horizontal direction. The facets receive direct light 40 from the light source 12 and reflect indirect light 42 through the lens 16. The light 30 from the lens 16 changes direction as the light 30 enters a rearward side 17" of the lens 16 and exits the forward side 17'.

Figure 9A:
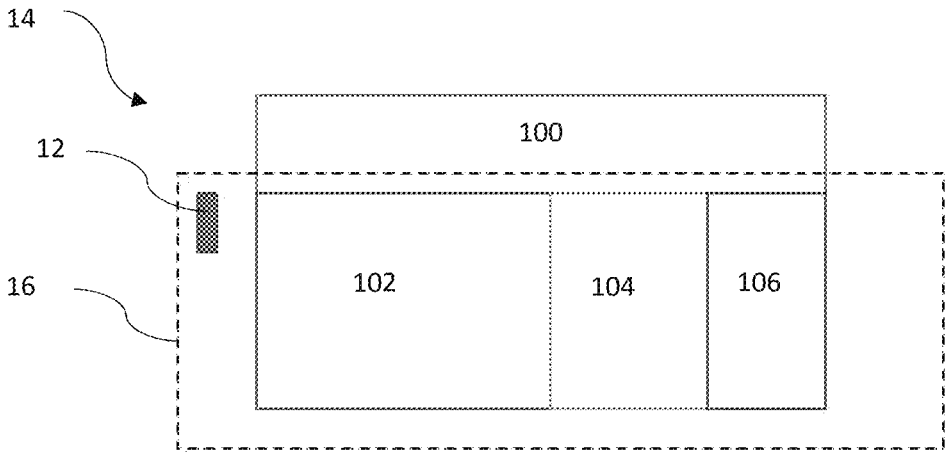
FIG. 9A illustrates reflective surfaces of a reflector in a kink unit.

FIG. 9A illustrates a light source 12, reflector 14, and lens 16. The lens 16 is longer than the reflector 14 and has a height greater than the reflector 14. The light source 12 is located off to one side of the reflector 14. The light source 12 directs light onto the reflector 14 and the reflector 14 redirects the light through different regions of the lens 16 and each of the regions spread the light in a different manner depending upon the shape and orientation of the facets and sub-facets as is discussed herein. The reflector 14 reflects a foreground light 100, a spread light 102, an intermediate light 104, and a cut off light 106, the pattern of which is visible in FIG. 9B.

Figure 9B:
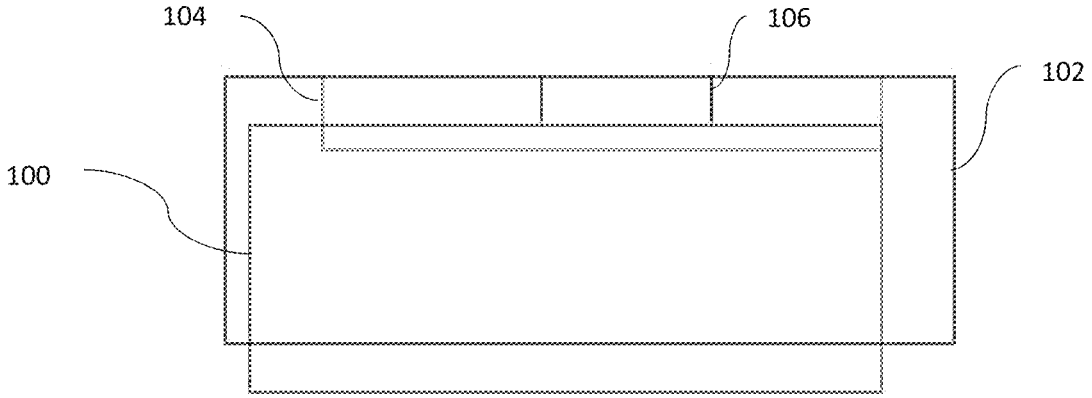
FIG. 9B illustrates the reflected light illumination regions extending though a lens in a kink unit.

FIG. 9B illustrates that pattern of reflected light extending through the lens (not shown). The foreground light 100 creates a rectangular pattern through the lens to illuminate a large region. The spread light 102 also creates a rectangular pattern but provides light outside of the foreground light 100. The intermediate light 104 illuminates a region between and overlapping a portion of the foreground light 100 and spread light 102. The cutoff light 106 creates a partial hotspot in front of a vehicle so that a region in a direction of movement is illuminated.

Figure 10A:
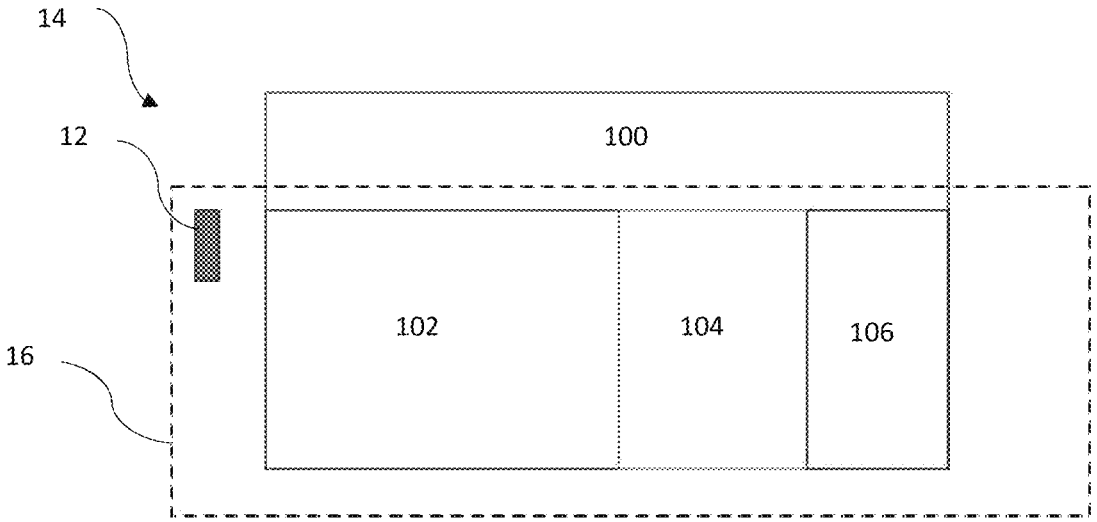
FIG. 10A illustrates reflective surfaces of a reflector in a flat unit.

FIG. 10A illustrates a light source 12, reflector 14, and lens 16. The lens 16 is longer than the reflector 14 and has a height greater than the reflector 14. The light source 12 is located off to one side of the reflector 14. The light source 12 directs light onto the reflector 14 and the reflector 14 redirects the light through different regions of the lens 16 and each of the regions spread the light in a different manner depending upon the shape and orientation of the facets and sub-facets as is discussed herein. The reflector 14 reflects a foreground light 100, a spread light 102, an intermediate light 104, and a cut off light 106, the pattern of which is visible in FIG. 10B.

Figure 10B:
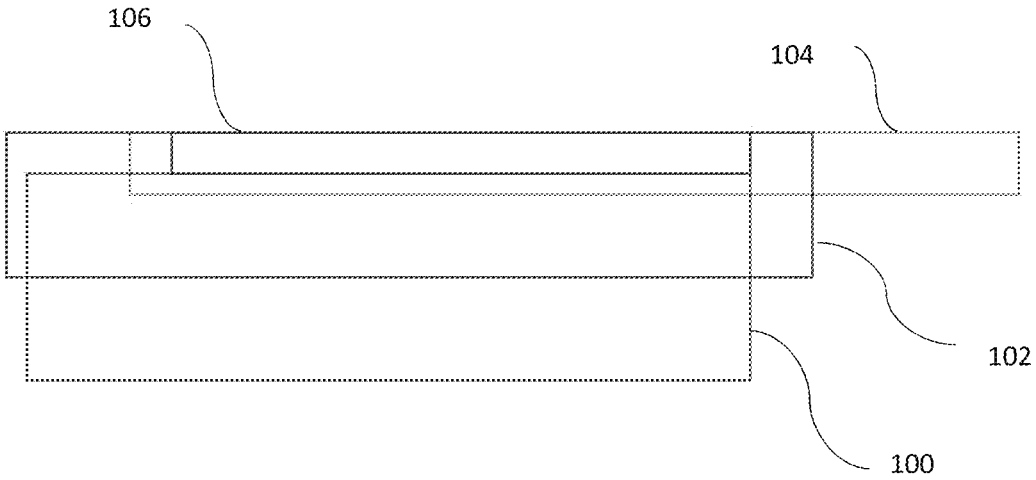
FIG. 10B illustrates the reflected light illumination regions extending though a lens in a flat unit.

FIG. 10B illustrates that pattern of reflected light extending through the lens (not shown). The foreground light 100 creates a rectangular pattern through the lens to illuminate a large region. The spread light 102 also creates a rectangular pattern but provides light outside of the foreground light 100 (e.g., has a greater length). The intermediate light 104 illuminates a region between and overlapping a portion of the foreground light 100 and spread light 102 and provides light to a region outside of a width of a vehicle (not shown), the foreground light 100, and the spread light 102. The cutoff light 106 creates a partial hotspot in front of a vehicle so that a region in a direction of movement is illuminated.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

ELEMENT LIST

2 vehicle
4 Inboard side
6 Outboard side
10 Light System
12 Light Source
14 Reflector
16 Lens
17' Forward side
17" Rearward side
18 lens
20 Direction of Movement
22 Facets
24 Outside edge
30 Light
32 Kink
34 Spread
36 High beam
40 Direct light
42 Reflected Light
44 Reflector facet
46 Sub-facets
50 Isocandela
52 Direct light (edges/region)
54 Reflected light (edges/region)
70 Vertical Axis
72 Horizontal axis
74 Optical Axis
76 Longitudinal axis
90 Shield
100 Foreground light
102 Spread light
104 Intermediate light
106 Cutoff light
H Height

I claim:

1. A light system of a vehicle, the light system comprising:
a) one or more reflectors having a top, a bottom, a first side, and a second side;
b) a lens;
c) an optical axis extending through the one or more reflectors and bisecting the lens in a direction away from the light system when the light system is located within the vehicle; and
d) a light source horizontally coplanar with the one or more reflectors and located farther from the optical axis on the first side or the second side than an outside edge on the first side or the second side respectively of each of the one or more reflectors so that light from the light source is directed at an angle relative to the one or more reflectors and the one or more reflectors redirect the light through the lens away from the light system so that the light illuminates a predetermined area in front of the vehicle.

2. The light system of claim 1, wherein the one or more reflectors have a plurality of facets.

3. The light system of claim 2, wherein the plurality of facets extend in a vertical direction relative to the top and the bottom so that a vertical surface of the one or more reflectors is generally curved.

4. The light system of claim 2, wherein the plurality of facets extend in a horizontal direction relative to the first side and the second side so that a horizontal surface of the one or more reflectors is generally curved.

5. The light system of claim 2, wherein the plurality of facets in a horizontal direction relative to the first side and the second side create steps in the one or more reflectors that curve the one or more reflectors and the plurality facets in a vertical direction relative to the top and the bottom curve the one or more reflectors inward so that a concave surface is formed.

6. The light system of claim 1, wherein an area of the one or more reflectors is greater than an area of the lens.

7. The light system of claim 1, wherein a height of the one or more reflectors relative to the top and bottom is greater than a height of the lens.

8. The light system of claim 1, wherein the one or more reflectors is a plurality of reflectors, the light source is a plurality of light sources, and the lens is a single lens and all of the light from each the plurality of light sources is directed to one of the plurality of reflectors so that one of the plurality of light sources directs light to one of the plurality of reflectors and all of the light is redirected through the single lens.

9. The light system of claim 1, wherein the light from the light source extends at an angle of about 15 degrees or more and about 135 degrees or less from the light source into contact with the one or more reflectors.

10. The light system of claim 1, wherein the light redirected by the one or more reflectors redirects the light by an angle of about 25 degrees or more and about 115 degrees or less.

11. The light system of claim 1, wherein the light source is coplanar with a center of the one or more reflectors and is located on a horizontal axis that bisects the one or more reflectors.

12. The light system of claim 1, wherein the lens is an inner lens that is located between an outer lens and the one or more reflectors.

13. The light system of claim 1, wherein the one or more reflectors are a single reflector with a plurality of facets that create steps in the single reflector.

14. The light system of claim 1, wherein the one or more reflectors are a plurality of reflectors that are located adjacent to one another to form a reflector.

15. The light system of claim 1, wherein the one or more reflectors are generally parabolic in shape.

16. The light system of claim 1, wherein the one or more reflectors include a plurality of facets and each of the facets include one or more sub-facets.

17. The light system of claim 16, wherein the plurality of facets includes one or more facets that direct light to be foreground light, one or more facets that direct light to be spread light, one or more facets that direct light to be intermediate light, and one or more facets that direct light to be cutoff light.

18. The light system of claim 1, wherein the first side of the reflector is located closer to the lens then the second side of the reflector and the light source is located on the second side of the reflector.

* * * * *